US006931881B1

(12) United States Patent
Movshovitz

(10) Patent No.: US 6,931,881 B1
(45) Date of Patent: Aug. 23, 2005

(54) PORTABLE MONOBLOCK AIR CONDITIONER

(75) Inventor: Avner Movshovitz, Tel Aviv (IL)

(73) Assignee: Amcor International Ltd., Pituach (IL)

( * ) Notice: Subject to any disclaimer, the term of this patent is extended or adjusted under 35 U.S.C. 154(b) by 0 days.

(21) Appl. No.: 10/950,484

(22) Filed: Sep. 28, 2004

(51) Int. Cl.[7] ..... F25B 47/00
(52) U.S. Cl. ..... 62/279; 62/93; 62/95; 62/305
(58) Field of Search ..... 62/93, 95, 271, 62/277, 278, 279, 305, 309, 314

(56) References Cited

U.S. PATENT DOCUMENTS 4,067,205 A * 1/1978 Mayhue ..... 62/279
6,434,963 B1 * 8/2002 Urch ..... 62/279

FOREIGN PATENT DOCUMENTS

JP 57-187116 * 5/1984
JP 58-15847 * 8/1984
JP 59-26512 * 8/1984

* cited by examiner

*Primary Examiner*—Melvin Jones
(74) *Attorney, Agent, or Firm*—Dekel Patent Ltd.; David Klein

(57) ABSTRACT

A portable, monoblock air conditioner including an evaporator positioned over a condenser, the condenser including heat transfer fins, and a partition positioned between the evaporator and the condenser, the partition formed with openings arranged for condensate to flow from the evaporator over the heat transfer fins of the condenser, wherein there are more than one of the openings over each heat transfer fin. Adjacent rows of openings over the heat transfer fins may be staggered with respect to each other. The heat transfer fins may have a hydrophilic coating.

6 Claims, 2 Drawing Sheets

PORTABLE MONOBLOCK AIR CONDITIONER

FIELD OF THE INVENTION

The present invention relates generally to portable, monoblock air conditioners, and particularly to such an air conditioner constructed such that water condensed in the evaporator is evaporated over the condenser.

BACKGROUND OF THE INVENTION

In the art of air conditioning, one well-known device is the monoblock (or as it is commonly spelled in Europe "monobloc"). The monoblock air conditioner is a single packaged mobile or portable air conditioner (the terms "mobile" and "portable" being used interchangeably). A typical monoblock air conditioner is a one piece unit with a flexible discharge hose, and does not have a remote condenser.

As is well known in the art, air conditioners typically include an evaporator and condenser. The evaporator provides cooling by evaporating a refrigerant from a liquid to a gas, which causes heat within the room air to be transferred to the refrigerant. The heated refrigerant is condensed in the condenser, wherein the heat absorbed by the refrigerant is rejected or transferred to some other medium, such as forced air. Indeed in most normal air conditioners, the condenser is cooled by the outdoors air and/or a fan. In a portable monoblock one-ducted air conditioner, the condenser is typically cooled by air which has been sucked from the air conditioned room. This warmed air is typically evacuated by a flexible hose to the outdoors.

In normal air conditioners, any water condensed in the evaporator may be drained by a flexible hose, wherein the water simply flows by gravity to a drain. However, this is not the case when it comes to portable monoblock air conditioners. In one-ducted monoblock air conditioners, because of its portable nature, there is no friendly way of draining the water by gravitation to the drain.

One problem common to all air conditioners is the rising cost of electrical energy. It is desirable to reduce the cost of cooling by making the air conditioners more efficient. One way of increasing the efficiency is to improve the cooling of the hot refrigerant gas in the condenser. Most condensers are air cooled and thus depend on forced ambient air for the necessary cooling air. When the ambient air temperature rises, the efficiency of the air conditioner falls and when the air conditioner is needed most, it is least efficient. One method which has been tried is to spray water onto the condenser coils in order that the water, which usually is below the ambient air temperature, may cool the coils by taking in the heat and with some evaporation, taking the caloric value of the heat of vaporization of water from the heated refrigerant.

Reference is now made to FIG. 1, which illustrates a prior art portable, monoblock, one-ducted air conditioner 10. The air conditioner 10 includes an evaporator 12 which sits above a condenser 14. An upper pan 16 is provided with holes for dripping condensed water from the evaporator 12 over the condenser 14. The condensate splashes over the hot condenser 14 and evaporates, which cools the condenser 14 and thus minimizes the amount of air that must be sucked from the room to cool the condenser 14.

However, in prior art portable, monoblock, one-ducted air conditioners, this technique is not efficient. In prior art monoblock air conditioners, the condenser 14 does not evaporate the condensed water at the same rate the condensate is produced in the evaporator 12. Accordingly, a lower pan 18 is provided below the condenser 14 to collect any water that has not evaporated over the condenser coils. A pump is provided to pump the non-evaporated water back up to the upper pan 16 for re-dripping over the condenser 14.

SUMMARY OF THE INVENTION

The present invention seeks to provide an improved portable monoblock air conditioner, as described more in detail hereinbelow. The air conditioner may be one-ducted.

There is thus provided in accordance with an embodiment of the present invention a portable, monoblock air conditioner including an evaporator positioned over a condenser, the condenser including heat transfer fins, and a partition positioned between the evaporator and the condenser, the partition formed with openings arranged for condensate to flow from the evaporator over the heat transfer fins of the condenser, wherein there are more than one of the openings over each heat transfer fin. Adjacent rows of openings over the heat transfer fins may be staggered with respect to each other. The rate at which the condensate is formed and flows through the openings of the partition does not exceed the rate at which the condenser is capable of evaporating the condensate into vapor, so that substantially all of the condensate is evaporated by the condenser into vapor.

BRIEF DESCRIPTION OF THE DRAWINGS

The present invention will be understood and appreciated more fully from the following detailed description taken in conjunction with the drawings in which.

DETAILED DESCRIPTION OF THE PREFERRED EMBODIMENT

Figure 1:
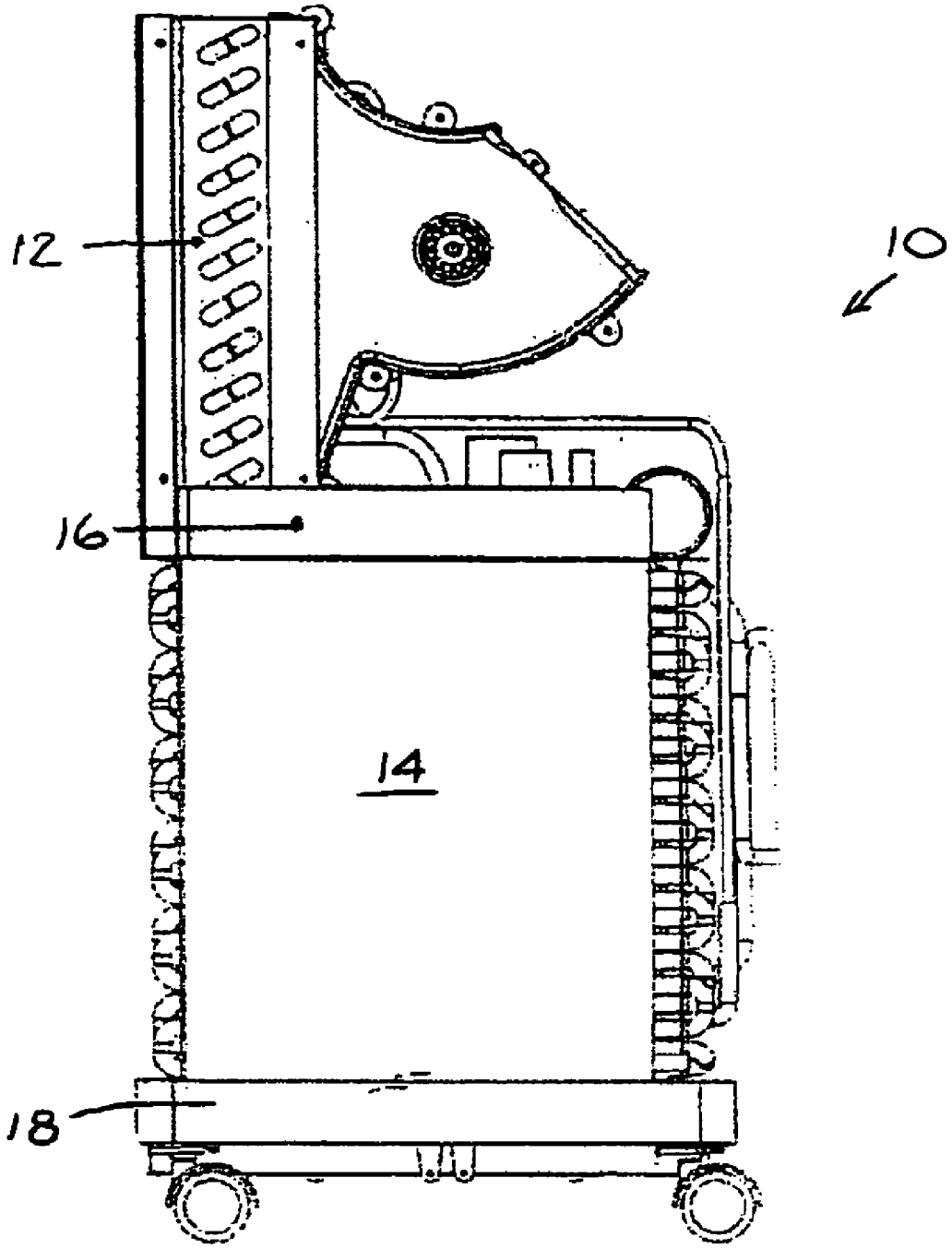
FIG. 1 PRIOR ART
FIG. 1 is a simplified pictorial illustration of a prior art portable, monoblock, one-ducted air conditioner.
Figure 2:
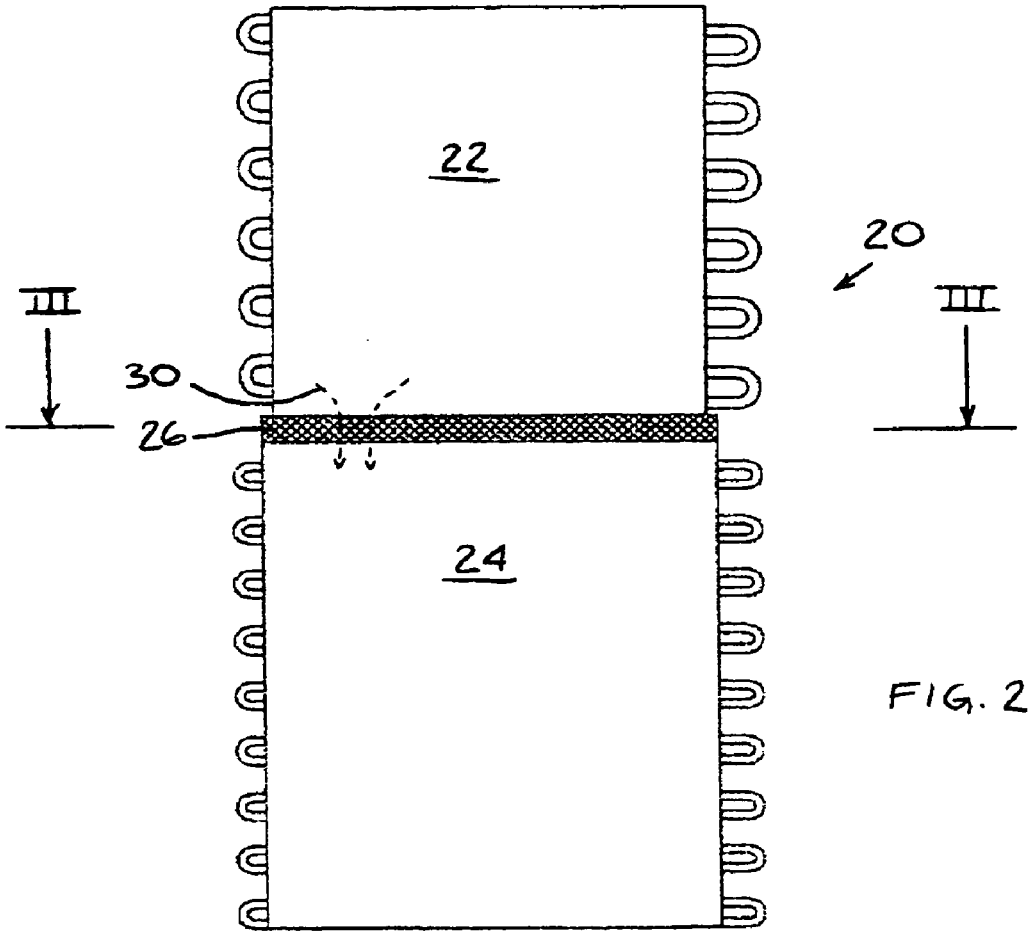
FIG. 2 is a simplified pictorial illustration of a portable, monoblock air conditioner, constructed and operative in accordance with an embodiment of the present invention.

Reference is now made to FIG. 2, which illustrates a portable, monoblock air conditioner 20, constructed and operative in accordance with an embodiment of the present invention. Air conditioner 20 may be one-ducted.

Figure 3:
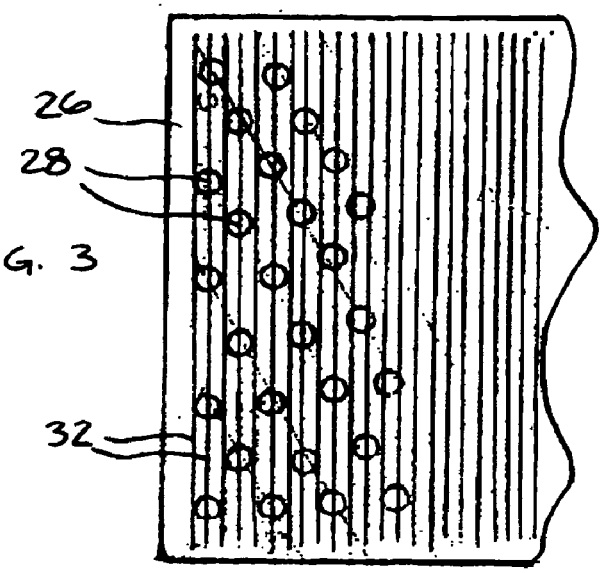
FIG. 3 is a simplified illustration of a partition used in the air conditioner of FIG. 2.

Air conditioner 20 may include an evaporator 22 positioned over a condenser 24. In accordance with an embodiment of the present invention, a partition 26 is positioned between the evaporator 22 and the condenser 24. As seen in FIG. 3, the partition 26 may be formed with openings 28 arranged for condensate 30 to flow from the evaporator 22 over the condenser 24. The openings 28 may be sized such that the rate at which the condensate 30 is formed at the evaporator 22 and flows through the openings 28 does not exceed the rate at which the condenser 24 is capable of evaporating the condensate 30 into vapor. In this manner, substantially all of the condensate 30 is evaporated by the condenser 24 into vapor. In other words, substantially all of the condensate 30 is evaporated and not carried out by the expelled air as tiny drops.

For example, if the rate at which the condensate 30 is formed at the evaporator 22 is 1 liter/hour (which is a function of the operating conditions and capability of the evaporator 22), the condenser 24 is designed so that it evaporates the condensate 30 into vapor at a minimum rate of 1 liter/hour (which is a function of the operating conditions and capability of the condenser 24), and the openings 28 are sized to permit a minimum flow rate of 1 liter/hour.

The partition 26 may be constructed of a thermal insulating material, such as but not limited to, an engineering plastic (e.g., TEFLON, DELRIN, polycarbonate, polyurethane and many others). This may help prevent heat from being transferred from the relatively hot condenser 24 to the evaporator 22. Further, the partition 26 may be constructed of a vibration damping material (e.g., polyurethane, synthetic or natural rubber or other elastomer) to ensure quiet operation of the air conditioner 20.

The condenser 24 may be arranged with respect to the partition 26 such that the condensate 30 flows over heat transfer fins 32 of the condenser 24. As seen in FIG. 3, there is more than one opening 28 over each heat transfer fin 32, thereby ensuring that each fin 32 gets wetted by the condensate 30. The openings 28 may be arranged in staggered rows, that is, adjacent rows of openings 28 over the heat transfer fins 32 are staggered with respect to each other. This may help ensure that the condensate 30 flows evenly over heat transfer fins 32. The heat transfer fins 32, which may be made of an aluminum alloy, may have a hydrophilic coating. Many hydrophilic coatings are known and can be used, such as but not limited to, bis-(2-pyridylthio)-zinc-1,1'-dioxide, which besides being hydrophilic is also antibacterial and antifungal. The hydrophilic coating may also help attract the condensate 30 towards the fins 32.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A portable, monoblock air conditioner comprising:

an evaporator positioned over a condenser, said condenser comprising heat transfer fins; and a partition positioned between said evaporator and said condenser, said partition formed with openings arranged for condensate to flow from said evaporator over said heat transfer fins of said condenser, wherein there are more than one of said openings over each heat transfer fin.

2. The portable, monoblock, one-ducted air conditioner according to claim 1, wherein adjacent rows of openings over the heat transfer fins are staggered with respect to each other.

3. The portable, monoblock, one-ducted air conditioner according to claim 1, wherein heat transfer fins of said condenser comprise a hydrophilic coating.

4. The portable, monoblock, one-ducted air conditioner according to claim 1, wherein the rate at which said condensate is formed and flows through said openings of said partition does not exceed the rate at which said condenser is capable of evaporating said condensate into vapor, so that substantially all of said condensate is evaporated by said condenser into vapor.

5. The portable, monoblock, one-ducted air conditioner according to claim 1, wherein said partition is constructed of a thermal insulating material.

6. The portable, monoblock, one-ducted air conditioner according to claim 1, wherein said partition is constructed of a vibration damping material.

* * * * *